US009683569B2

(12) United States Patent
Collins et al.

(10) Patent No.: US 9,683,569 B2
(45) Date of Patent: Jun. 20, 2017

(54) COMPRESSOR SYSTEM HAVING ROTOR WITH DISTRIBUTED COOLANT CONDUITS AND METHOD

(71) Applicant: INGERSOLL-RAND COMPANY, Davidson, NC (US)

(72) Inventors: James Christopher Collins, Mooresville, NC (US); Willie Dwayne Valentine, Statesville, NC (US); Stephen James Collins, Mooresville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 47 days.

(21) Appl. No.: 14/837,945

(22) Filed: Aug. 27, 2015

(65) Prior Publication Data

US 2017/0058896 A1 Mar. 2, 2017

(51) Int. Cl.

| | |
|---|---|
| ***F01C 21/04*** | (2006.01) |
| ***F04C 18/107*** | (2006.01) |
| ***F04C 29/00*** | (2006.01) |

(52) U.S. Cl.

CPC ..... *F04C 18/107* (2013.01); *F04C 29/0007* (2013.01)

(58) Field of Classification Search

CPC ..... F04C 29/065; F04C 18/16

See application file for complete search history.

(56) References Cited

U.S. PATENT DOCUMENTS

| | | | | |
|---|---|---|---|---|
| 2,325,617 A | | 8/1943 | Lysholm et al. | |
| 2,714,314 A | | 8/1955 | Ulander | |
| 2,799,253 A | | 7/1957 | Lindhagen et al. | |
| 2,801,792 A | | 8/1957 | Lindhagen et al. | |
| 2,918,209 A | | 12/1959 | Schueller | |
| 3,405,604 A | | 10/1968 | Lysholm | |
| 4,005,955 A | * | 2/1977 | Pamlin | F01C 21/06 418/94 |
| 5,772,418 A | | 6/1998 | Tateno et al. | |
| 6,045,343 A | | 4/2000 | Liou | |
| 6,758,660 B2 | | 7/2004 | Kriehn et al. | |
| 7,793,516 B2 | * | 9/2010 | Farrow | F04C 18/10 123/200 |
| 7,993,118 B2 | | 8/2011 | Prior et al. | |

(Continued)

FOREIGN PATENT DOCUMENTS

| | | |
|---|---|---|
| CN | 102242711 | 1/2014 |
| DE | 1021530 B | 12/1957 |
| EP | 1026399 | 8/2000 |

(Continued)

OTHER PUBLICATIONS

Jan. 31, 2017, European Search Report and Written Opinion, European Patent Application No. 16185303.1, 9 pages.

*Primary Examiner* — Jesse Bogue

(74) *Attorney, Agent, or Firm* — Taft Stettinius & Hollister

(57) ABSTRACT

A compressor includes a rotor having an outer compression surface and a plurality of inner heat exchange surfaces. A coolant supply manifold fluidly connects with a coolant inlet in a first axial end of the rotor, and delivers coolant fluid by way of conduits having an axial distribution in the rotor so as to deliver coolant fluid to the heat exchange surfaces. The coolant may be a refrigerant that undergoes a phase change within the rotor.

20 Claims, 6 Drawing Sheets

(56) References Cited

U.S. PATENT DOCUMENTS

| | | | | |
|---|---|---|---|---|
| 8,192,186 | B2 | 6/2012 | Moens | |
| 2016/0123327 | A1* | 5/2016 | Collins | F04C 29/04<br>418/201.2 |

FOREIGN PATENT DOCUMENTS

| | | | |
|---|---|---|---|
| GB | 690185 | A | 4/1953 |
| WO | 20060024818 | A1 | 3/2006 |

* cited by examiner

COMPRESSOR SYSTEM HAVING ROTOR WITH DISTRIBUTED COOLANT CONDUITS AND METHOD

TECHNICAL FIELD

The present disclosure relates generally to compressor rotors, and more particularly to compressor rotor cooling.

BACKGROUND

A wide variety of compressor systems are used for compressing gas. Piston compressors, axial compressors, centrifugal compressors and rotary screw compressors are all well-known and widely used. Compressing gas produces heat, and with increased gas temperature the compression process can suffer in efficiency. Removing heat during the compression process can improve efficiency. Moreover, compressor equipment can suffer from fatigue or performance degradation where temperatures are uncontrolled. For these reasons, compressors are commonly equipped with cooling mechanisms.

Compressor cooling generally is achieved by way of introducing a coolant fluid into the gas to be compressed and/or cooling the compressor equipment itself via internal coolant fluid passages, radiators and the like. Compressor equipment cooling strategies suffer from various disadvantages relative to certain applications.

SUMMARY

A compressor system includes a housing and a rotor rotatable within the housing. The housing has a coolant inlet, a coolant outlet, and a coolant manifold fluidly connected with the coolant inlet. The rotor further has coolant delivery conduits with an axial and circumferential distribution, that extend outwardly from the manifold to supply coolant fluid to inner heat exchange surfaces of the rotor.

DETAILED DESCRIPTION OF THE FIGURES

Figure 1:
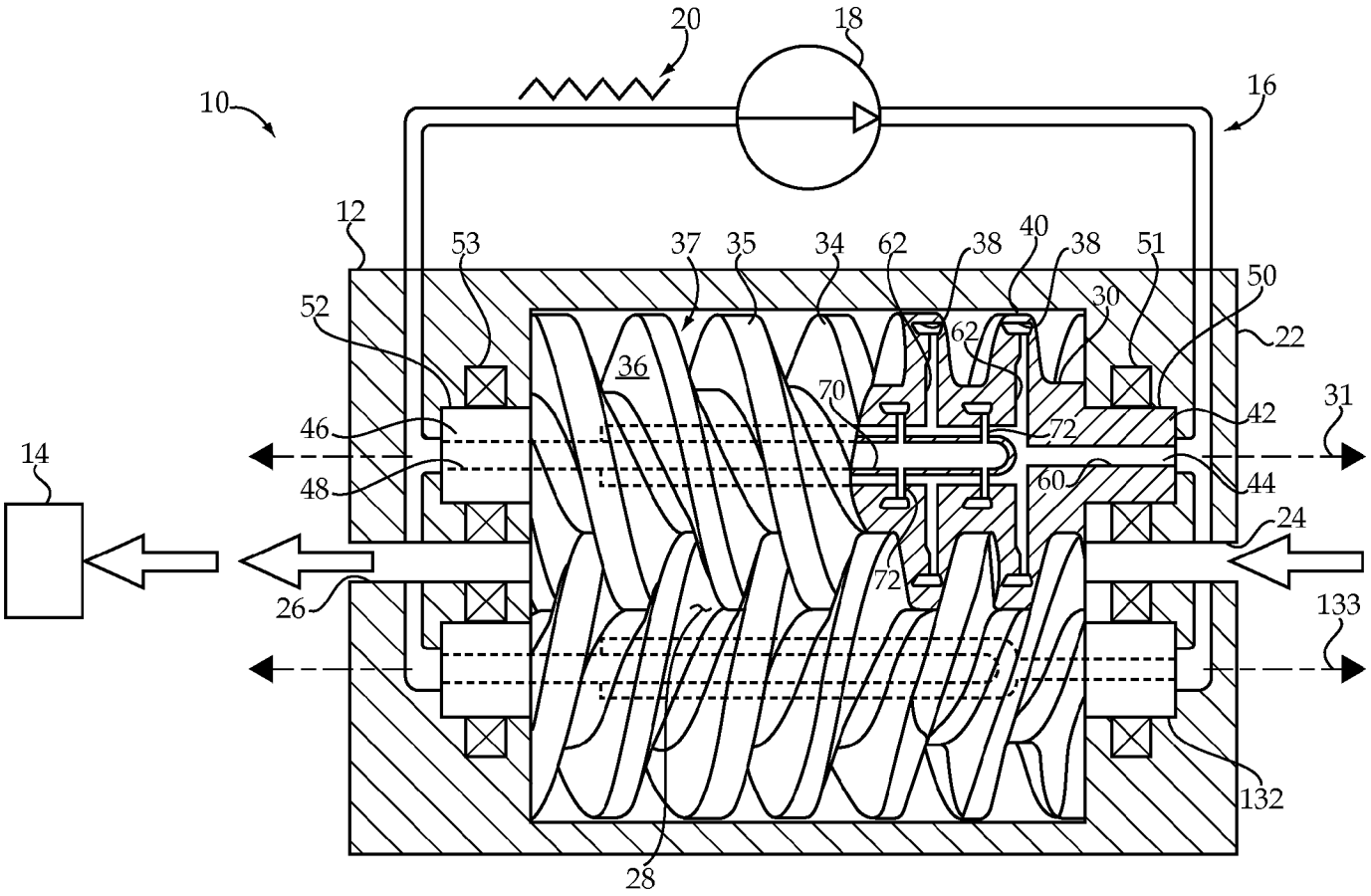
FIG. 1 is a partially sectioned diagrammatic view of a compressor system according to one embodiment.

For the purposes of promoting an understanding of the principles of the Compressor System Having Rotor With Distributed Coolant Conduits And Method, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, there is shown a compressor system 10 according to one embodiment and including a compressor 12, a compressed air powered device or storage vessel 14, and a cooling system having a coolant loop 16, a coolant pump 18 and a radiator 20 or the like. Compressor 12 may be of the dual or twin rotary screw type, as further discussed herein, although the present disclosure is not thusly limited. Compressor 12 includes a compressor housing 22 having formed therein a gas inlet 24, a gas outlet 26, and a fluid conduit 28 extending between gas inlet 24 and gas outlet 26. A rotor 30 is rotatable within housing 22 about an axis of rotation 31 to compress gas conveyed between gas inlet 24 and gas outlet 26. In the illustrated embodiment, compressor 12 includes rotor 30 and also a second rotor 132 rotatable about a second and parallel axis of rotation 133. While rotors 30 and 132 are shown having similar configurations, it should be appreciated that dual rotary screw compressors according to the present disclosure will typically include a male rotor and a female rotor, example features of which are further described herein. Except where otherwise indicated, the present description of one of rotors 30 and 132, and any of the other rotors discussed herein, should be understood as generally applicable to the present disclosure. As will be further apparent from the following description, by virtue of unique cooling strategies and rotor construction the present disclosure is expected to be advantageous respecting system reliability and operation, as well as efficiency in compressing gasses such as air, natural gas, or others.

Rotor 30 includes an outer compression surface 36 exposed to fluid conduit 28, and at least one inner heat exchange surface 38. In a practical implementation strategy, rotor 30 includes a screw rotor where outer compression surface 36 includes a plurality of helical lobes 35 in an alternating arrangement with a plurality of helical grooves 37. As noted above, rotor 30 may be one of a male rotor and a female rotor, and rotor 132 may be the other of a male rotor and a female rotor. To this end, in a known manner lobes 35 might have a generally convex cross-sectional profile formed by convex sides, where rotor 30 is male. In contrast, where structured as female rotor 132 may have concave or undercut side surfaces forming the lobes. Lobes 35 and grooves 37 might be any configuration or number without departing from the present disclosure, so long as they have a generally axially advancing orientation sufficient to enable impingement of outer compression surface 36 on gas within fluid conduit 28 when rotor 30 rotates.

Rotor 30 may further include an outer body wall 40 extending between outer compression surface 36 and inner heat exchange surface 38. During operation, the compression of gas via rotation of rotor 30 generates heat, which is conducted into material from which rotor 30 is formed. Heat will thus be conducted through wall 40 from outer compression surface 36 to heat exchange surface 38. Rotor 30 further includes a first axial end 42 having a coolant inlet 44 formed therein, and a second axial end 46 having a coolant outlet 48 formed therein. A coolant manifold 60 fluidly connects with coolant inlet 44. Each of first and second axial ends 42 and 46 may include a cylindrical shaft end having a cylindrical outer surface 50 and 52, respectively. Journal and/or thrust bearings 51 and 53 are positioned upon axial ends 42 and 46, respectively, to react axial and non-axial loads and to support rotor 30 for rotation within housing 22 in a conventional manner.

As mentioned above, heat is conducted through wall 40 and otherwise into material of rotor 30. Coolant may be conveyed, such as by pumping, into coolant inlet 44, and thenceforth into manifold 60. Suitable coolants include conventional refrigerant fluids, gasses of other types, water, chilled brine, or any other suitable fluid of gaseous or liquid form that can be conveyed through rotor 30. Rotor 30 also includes a plurality of coolant supply conduits 62 having an axial and circumferential distribution. Conduits 62 extend outwardly from coolant manifold 60 so as to deliver a coolant to heat exchange surface 38 at a plurality of axial and circumferential locations. As will be further apparent from the following description, rotor 30 might have many inner heat exchange surfaces, or only a single inner heat exchange surface. In a practical implementation strategy, material from which rotor body 34 is made will typically extend continuously between heat exchange surface 38 and outer compression surface 36, such that the respective surfaces could fairly be understood to be located at least in part upon outer body wall 40. Also in a practical implementation strategy, rotor body 34 is a one-piece rotor body or includes a one-piece section wherein coolant manifold 60 and conduits 62 are formed. In certain instances, rotor body 30 or the one-piece section may have a uniform material composition throughout. It is contemplated that rotor 30 can be formed by material deposition as in a 3D printing or other additive manufacturing process. Those skilled in the art will be familiar with uniform material composition in one-piece components that is commonly produced by 3D printing. It should also be appreciated that in alternative embodiments, rather than a uniform material composition 3D printing capabilities might be leveraged so as to deposit different types of materials in rotor body 34 or in parts thereof. Analogously, embodiments are contemplated where rotor body 34 is formed from several pieces irreversibly attached together, such as by friction welding or any other suitable process.

Returning to the subject of coolant delivery and distribution, as noted above coolant is delivered to the one or more heat exchange surfaces 38 at a plurality of axial and circumferential locations. From FIG. 1 it can be seen that conduits 62 are at a plurality of different axial locations, and also a plurality of different circumferential locations, relative to axis 31. It can further be seen that conduits 62 may be structured such that they narrow in diameter near surface 38 so as to form orifices. Whether or not such narrowing is used in a production embodiment can vary, however, the coolant can be understood to be sprayed in at least certain instances upon heat exchange surface or the multiple heat exchange surfaces 38 at the plurality of axial and circumferential locations. Where a refrigerant is used, the refrigerant may undergo a phase change within rotor 30, transitioning from a liquid form to a gaseous form and absorbing heat in the process. In other instances, refrigerant might be provided or supplied into rotor 30 in a gaseous form, still potentially at a temperature below a freezing point of water, or within another suitable temperature range, depending upon cooling requirements.

Figure 2:
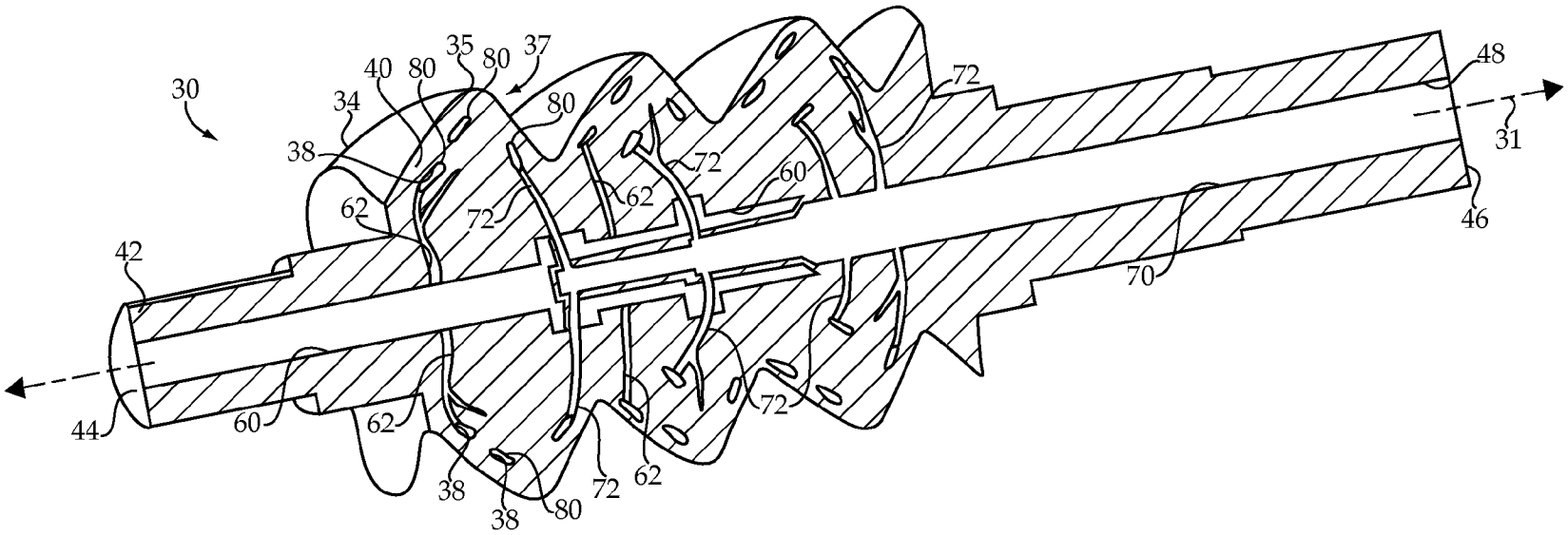
FIG. 2 is a sectioned view of a rotor suitable for use in a compressor system as in FIG. 1, according to one embodiment.

Referring also now to FIG. 2, there is shown a sectioned view of rotor 30 illustrating additional details, and also including geometry less diagrammatic in form than the geometry shown in FIG. 1. The generally helical shape of lobes 35 and grooves 37 is apparent in FIG. 2, as defined by surface 36. It can also be seen from FIG. 2 that multiple heat exchange surfaces 38 may be formed within a plurality of channels 80 for coolant, some of the channels being shown and visible in the cross-sectional view of FIG. 2 and others hidden. Surfaces 38 may have a generally arcuate shape that tracks the arcuate shape of channels 80, being axially and circumferentially advancing and tracking the arcuate and helical shape of lobes 35. As will be further apparent from the following description and additional drawings to be described, channels 80 may be each fed by a conduit 62, and arc about axis 31 while axially advancing within rotor body 34, and each typically but not necessarily traversing less than one full turn about axis 31.

In a practical implementation strategy, manifold 60 may include a coolant supply manifold, and rotor 30 may further include a coolant exhaust manifold 70 as shown in FIGS. 1 and 2. It can further be seen that exhaust manifold 70 and coolant supply manifold 60 are overlapping in axial extent. This means that certain axial locations, or an axial range of locations in rotor 30, are occupied by both supply manifold 60 and exhaust manifold 70. In a further practical implementation strategy, supply manifold 60 and exhaust manifold 70 are coaxial, with supply manifold 60 being radially outward from exhaust manifold 70. Another way to understand the relationship between supply manifold 60 and exhaust manifold 70 is that exhaust manifold 70 is positioned at least partially within supply manifold 60. It can be seen from FIG. 2 that supply manifold 60 may have a generally annular configuration and extends about exhaust manifold 70. Other configurations are certainly contemplated within the scope of the present disclosure, and supply manifold 60 and exhaust manifold 70 could in other embodiments be side by side rather than one within the other. It has been discovered that the overlapping axial extent of supply manifold 60 and exhaust manifold 70, and the overlapping axial distributions of coolant supply and coolant withdrawal in rotor 30, is advantageous with respect to thermal management and heat dissipation. In a practical implementation strategy, some of coolant supply conduits 62 may be positioned axially between some coolant exhaust outlets 72 and coolant outlet 48. Some of coolant exhaust conduits 72 may be positioned axially between some coolant supply conduits 62 and coolant inlet 44. Stated another way, cold coolant may be sprayed onto surfaces 38 at locations closer to axial end 46 than some of the locations where coolant is withdrawn after having exchanged heat with surfaces 38. While the present disclosure is not strictly limited as such, this configuration can help ensure that nowhere along the axial length of rotor 30 will the coolant actually be hotter than the air external to rotor 30 that is being compressed. At least some coolant delivery conduits 62 may pass radially through coolant exhaust manifold 70, as evident in FIGS. 1 and 2.

Figure 3:
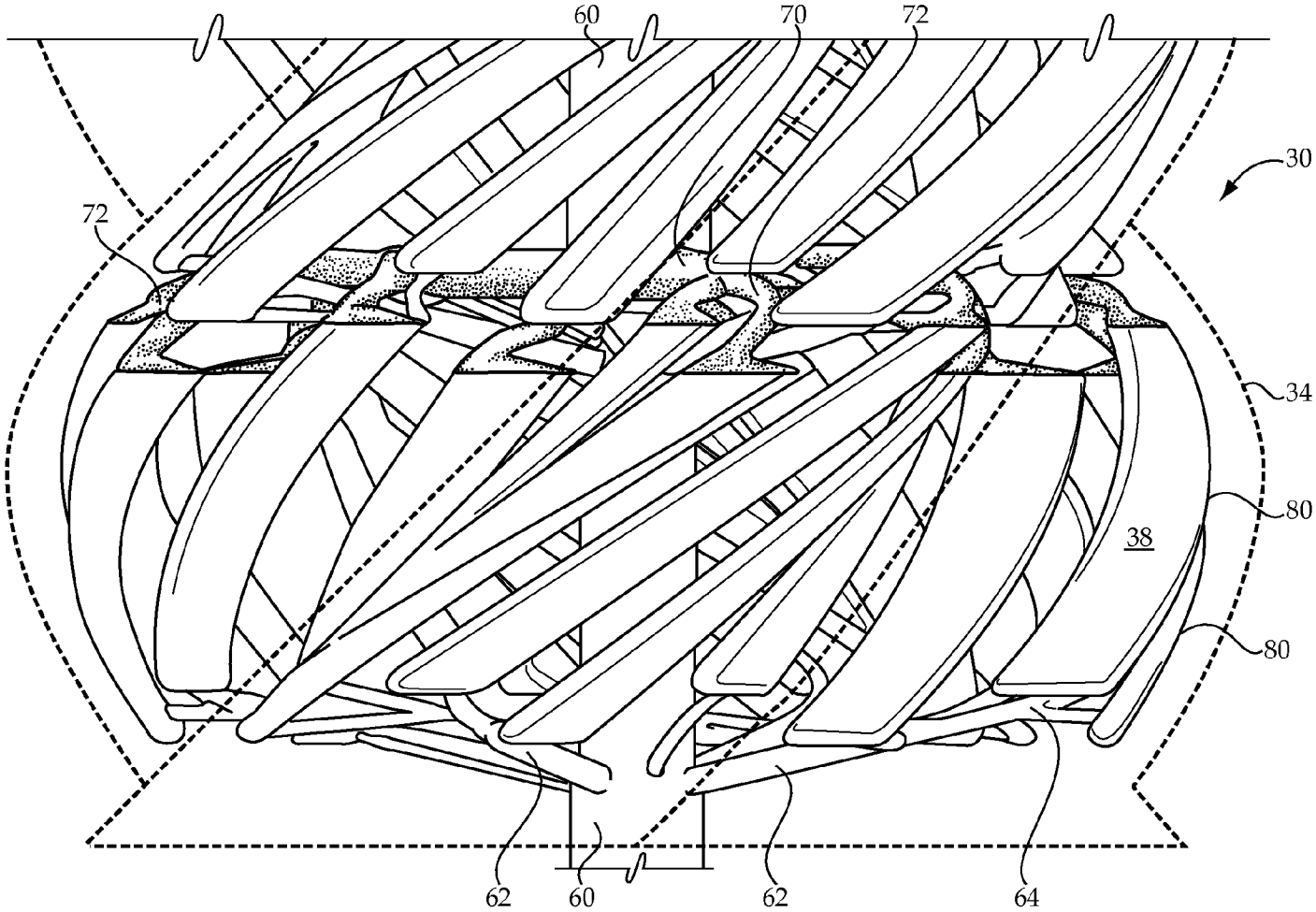
FIG. 3 is a partial, negative image view of a rotor, according to one embodiment.
Figure 4:
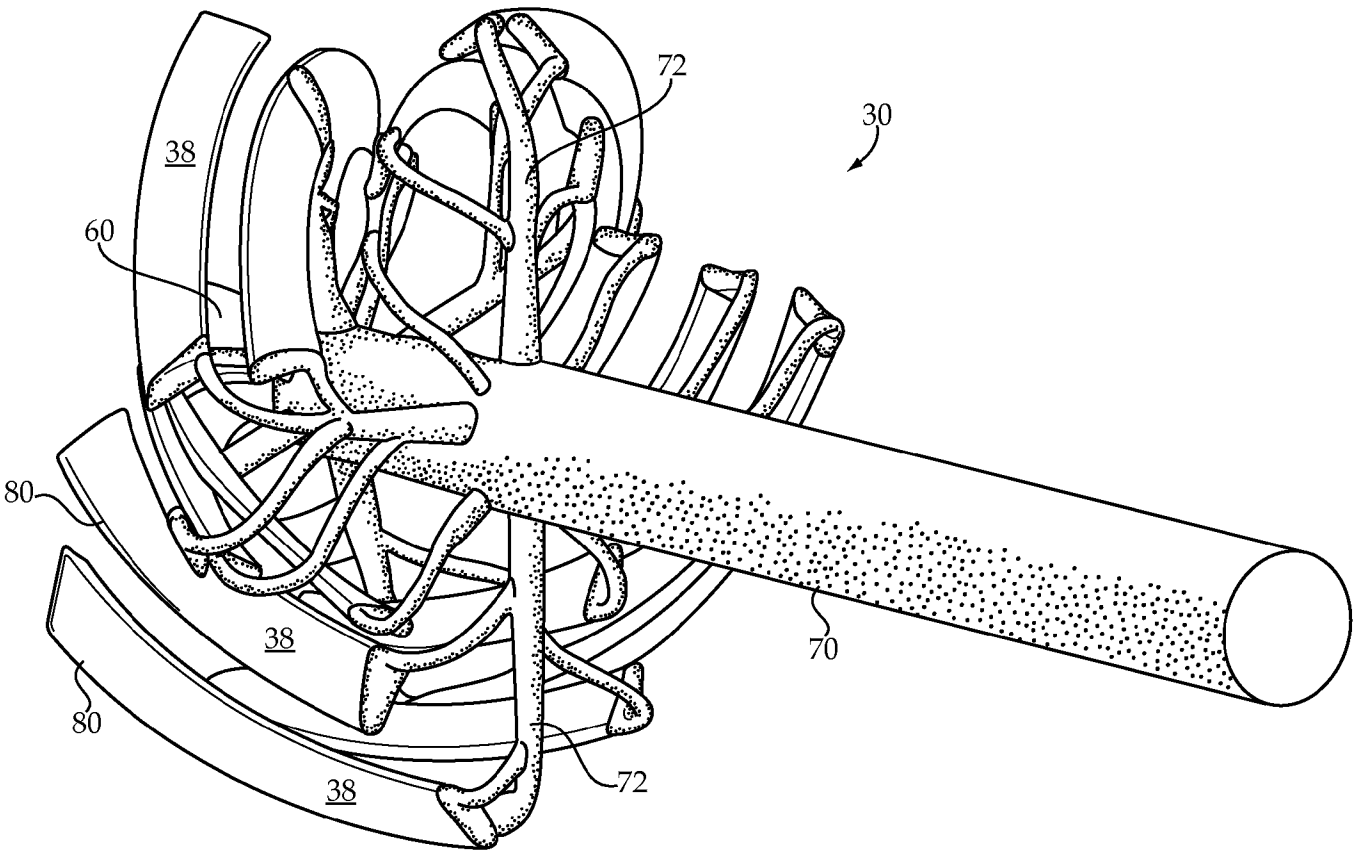
FIG. 4 is a partial, negative image view of internal cooling passages in a rotor, according to one embodiment.

Referring also now to FIG. 3, there is shown a negative image view of fluid passages within rotor body 34. In other words, the illustration in FIG. 3 shows in solid form features which are actually voids in rotor 30. It can be seen that a plurality of coolant supply conduits 62 extend radially outward from manifold 60 to channels 80. The arcuate shape of channels 80 is also readily apparent in FIG. 3. It can also be seen that some of conduits 62 branch so as to feed more than one channel 80. After the coolant passes through channels 80, and in the case of a refrigerant potentially changing phase, the coolant will pass through coolant exhaust conduits 72 and make its way back to exhaust manifold 70. In the FIG. 3 illustration only a relatively small part of exhaust manifold 70 is visible, and none of it might be visible, as conduit 70 is typically internal or in part internal to conduit 60. A branch 64 in one of conduits 62 is shown where multiple channels 80 are fed originally by a single conduit 62 from manifold 60. Turning also to FIG. 4, there is shown a partial view again including a negative image showing certain features of rotor 30 in solid form where those features are actually voids or cavities within rotor body 34. The generally curving nature of some of exhaust conduits 72, the branching of exhaust conduits 72, and the axial and circumferential distribution of exhaust conduits 72 as they extend inwardly to manifold 70 are readily apparent in FIG. 4. Some of the coolant passage features of rotor 30 are omitted from the FIG. 4 illustration for purposes of clarity.

Figure 5:
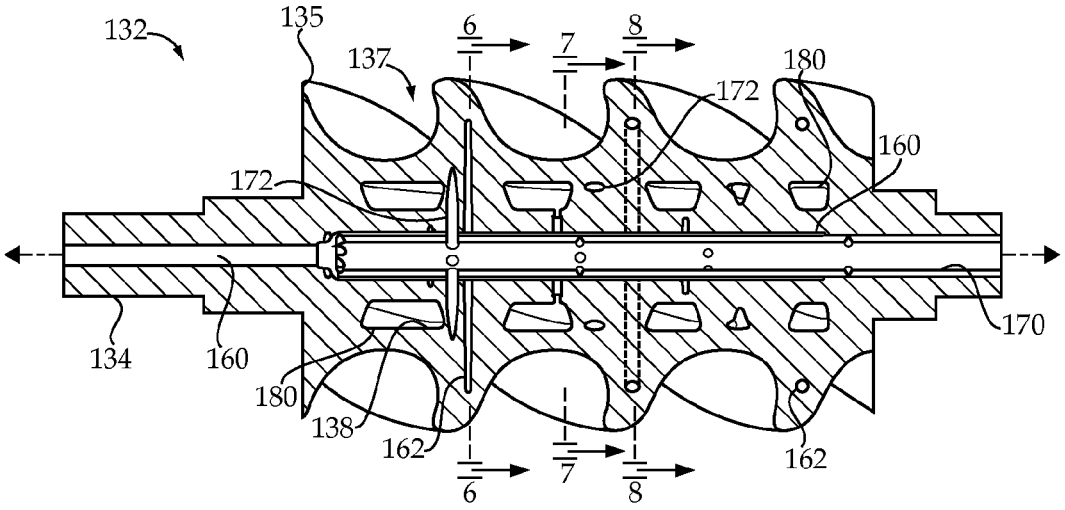
FIG. 5 is a sectioned view of a rotor suitable for use in a compressor system as in FIG. 1, according to one embodiment.

Referring now to FIG. 5, there is shown a sectioned side view of a rotor 132 of similar form to rotor 132 of FIG. 1 and accordingly illustrated with the same reference numerals. Rotor 132 includes a plurality of helical lobes 135 in an alternating arrangement with helical grooves 137, axially advancing along a rotor body 134. Rotor 132 may be of a female rotor form, where grooves 137 and lobes 135 are structured to enmesh with counterpart male lobes and grooves as in rotor 30, and where lobes 135 are undercut approximately as shown in FIG. 5. Rotor 132 also includes a manifold 160 for supply of coolant, and a coolant exhaust manifold 170. A plurality of coolant supply conduits 162 convey coolant from manifold 160 to channels 180 wherein heat exchange surfaces 138 are located, generally analogous to rotor 30. Exhaust conduits 172 are structured to convey coolant from channels 180 to exhaust conduit 170, and thenceforth out of rotor 132 such as for cooling compression and recirculation.

Figure 6:
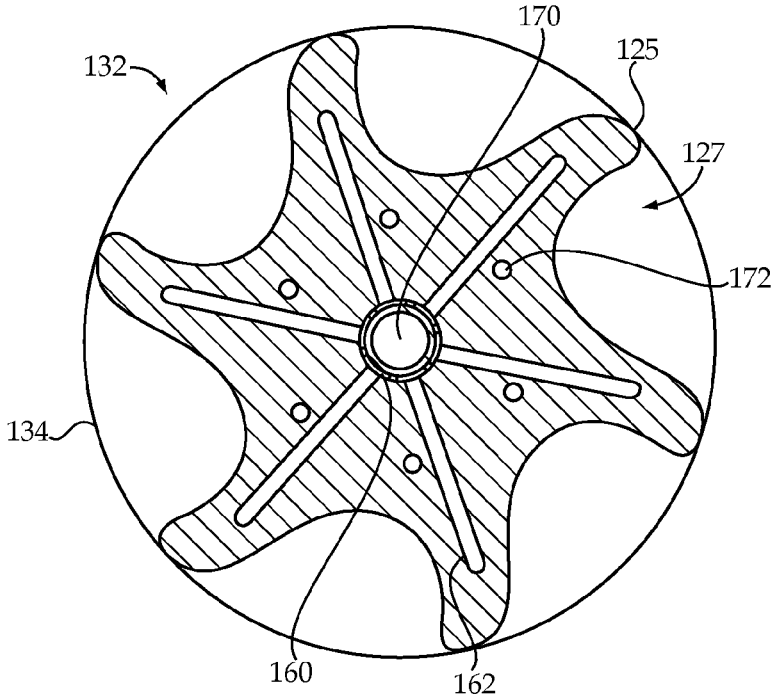
FIG. 6 is a sectioned view taken along line 6-6 of FIG. 5.
Figure 7:
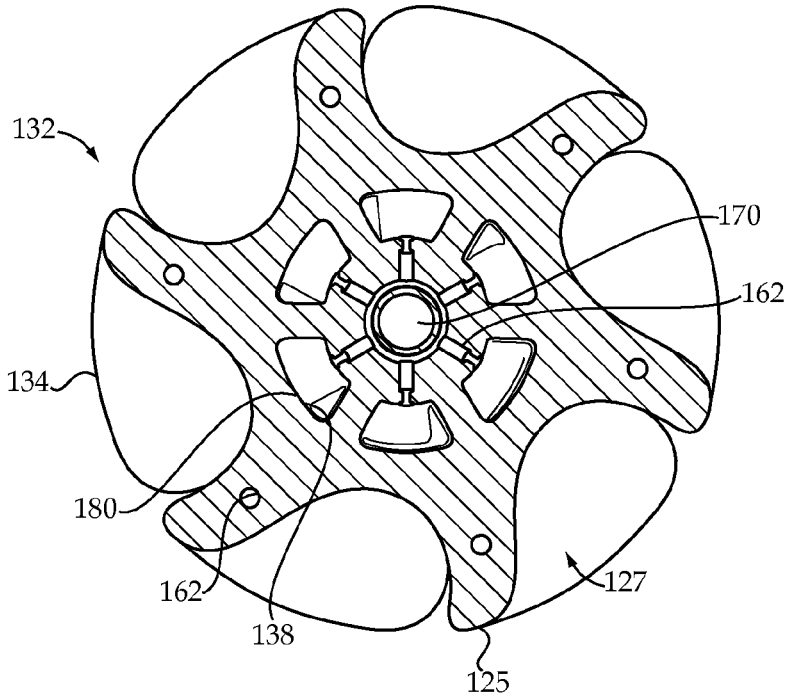
FIG. 7 is a sectioned view taken along line 7-7 of FIG. 5.
Figure 8:
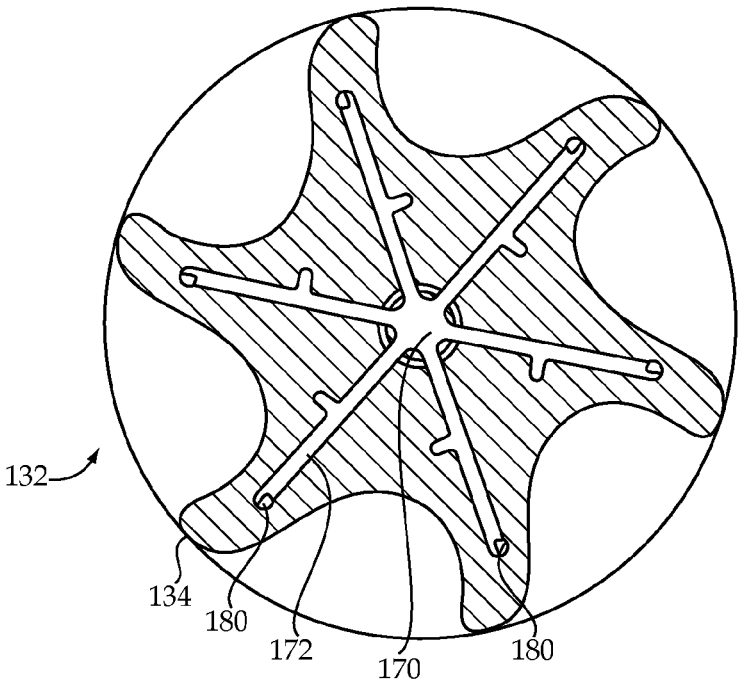
FIG. 8 is a sectioned view taken along line 8-8 of FIG. 5.

Rotor 132 as in FIG. 5 has certain similarities with rotor 30 discussed above, but certain differences. Referring now to FIG. 6, there is shown a sectioned view taken along line 6-6 of FIG. 5 wherein coolant supply conduits 162 are shown extending radially outward from supply manifold 160. In the view of FIG. 6 it can be seen that manifold 160 extends around manifold 170. The particular sectioned view of FIG. 6 extends also through exhaust conduits 172. It will thus be understood that channels or the like 180 extend between conduits 162 and conduits 172. Channels 180 may each be curved between an inlet end fed by a supply conduit 162 and an outlet end feeding an exhaust conduit 172. Referring also to FIG. 7, there is shown a sectioned view taken along line 7-7 of FIG. 5. Channels 180 are evident in FIG. 7, and shown being fed via coolant with conduits 162. Narrowing of conduits 162 at radially outward locations to form spray orifices is also visible. Referring also to FIG. 8, there is shown a sectioned view taken along line 8-8 of FIG. 5, where it can be seen that tips or ends of channels 180 are joined to conduits 172, feeding coolant having exchanged heat with surfaces 138 into conduits 172, and thenceforth into manifold 170 for removal from rotor 132.

Operating compressor system 10 and compressor 12 according to the present disclosure will generally occur analogously in each of the embodiments contemplated herein. Accordingly, the present description of rotor 30 should be understood to generally apply to any of the rotors contemplated herein. Rotor 30 may be rotated to compress a gas within housing 14 via impingement of outer compression surface 36 on the gas in a generally known manner. During rotating rotor 30, coolant may be conveyed into coolant manifold 60 within rotor 30, and from manifold 60 to coolant supply conduits 62. Heat exchange surface 38 may be sprayed with coolant from conduits 62 at a plurality of axially and circumferentially distributed locations, so as to dissipate heat that is generated by the compression of the gas. As noted above, the conveying and spraying may include conveying and spraying a refrigerant in liquid form that undergoes a phase change within rotor 30, which is then exhausted in gaseous form from rotor 30. The present disclosure is not limited as such, however, and other coolants and cooling schemes might be used.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A compressor system comprising:

a housing having formed therein a gas inlet, a gas outlet, and a fluid conduit extending between the gas inlet and the gas outlet;

a rotor rotatable within the housing about an axis of rotation, the rotor having an axial direction associated with the axis of rotation and a circumferential direction associated with a rotating motion about the axis of rotation, and the rotor having an outer compression surface exposed to the fluid conduit, a plurality of inner heat exchange surfaces, and an outer body wall extending between the outer compression surface and the plurality of inner heat exchange surfaces;

the rotor further including a first axial end having a coolant inlet formed therein, a second axial end having a coolant outlet formed therein, and a coolant manifold fluidly connected with the coolant inlet; and the rotor further including a plurality of coolant supply conduits having an axial and circumferential distribution, and each extending outwardly from the coolant manifold so as to supply a coolant to each of the plurality of inner heat exchange surfaces at a plurality of axial and circumferential locations, the rotor further including a plurality of coolant exhaust conduits each coupled with individual ones of the plurality of inner heat exchange surfaces, wherein separate flow paths are defined through the plurality of coolant supply conduits, plurality of inner heat exchange surfaces, and plurality of coolant exhaust conduits where the plurality of inner heat exchange surfaces extend between the plurality of coolant supply conduits and plurality of coolant exhaust conduits.

2. The system of claim 1 wherein the coolant manifold and the plurality of coolant supply conduits are formed in a one-piece section of the rotor body.

3. The system of claim 1 wherein the coolant manifold includes a coolant supply manifold, and the rotor further includes a coolant exhaust manifold.

4. The system of claim 3 wherein the plurality of coolant exhaust conduits having an axial and circumferential distribution and extending inwardly to the coolant exhaust manifold.

5. The system of claim 4 wherein the coolant supply manifold and the coolant exhaust manifold are overlapping in axial extent.

6. The system of claim 5 wherein the coolant supply manifold and the coolant exhaust manifold are coaxial.

7. The system of claim 1 wherein the outer compression surface forms a helical shape.

8. The system of claim 7 wherein the system includes a dual rotary screw compressor comprising a second rotor in parallel with the first rotor and intermeshed therewith.

9. The system of claim 1 wherein the plurality of coolant supply conduits include terminal nozzle orifices oriented to spray coolant onto the plurality of inner heat exchange surfaces.

10. A rotor for a compressor system comprising:

a rotor body defining a longitudinal axis extending between a first axial body end and a second axial body end, the rotor body having an axial direction associated with the longitudinal axis and a circumferential direction associated with a rotating motion about the longitudinal axis, and including an outer compression surface, a plurality of inner heat exchange surfaces, and an outer body wall extending between the outer compression surface and the plurality of inner heat exchange surfaces;

the rotor body further including a coolant inlet formed in the first axial body end, a coolant outlet formed in the second axial body end, and a coolant manifold fluidly connected with the coolant inlet; and the rotor body further including a plurality of coolant supply conduits having an axial and circumferential distribution, and extending outwardly from the coolant manifold so as to supply a coolant to the plurality of inner heat exchange surfaces at a plurality of axial and circumferential locations, the rotor body further including a plurality of coolant exhaust conduits each coupled with individual ones of the plurality of inner heat exchange surfaces, wherein flow paths are defined through pairings of the plurality of coolant supply conduits, plurality of inner heat exchange surfaces, and plurality of coolant exhaust conduits where the plurality of inner heat exchange surfaces extend between the plurality of coolant supply conduits and plurality of coolant exhaust conduits.

11. The rotor of claim 10 wherein each of the first and second axial body ends includes a cylindrical shaft end, for rotatably journaling the rotor body in a compressor housing, and the outer compression surface extending axially between the first and second axial body ends and defining a helical shape.

12. The rotor of claim 11 wherein the plurality of inner heat exchange surfaces includes a plurality of axially and circumferentially advancing heat exchange surfaces each having an arcuate shape.

13. The rotor of claim 11 wherein the coolant manifold and plurality of coolant supply conduits are formed in a one-piece section of the rotor body having a uniform material composition throughout.

14. The rotor of claim 11 comprising a screw rotor where the outer compression surface includes a plurality of helical lobes in an alternating arrangement with a plurality of helical grooves.

15. The rotor of claim 10 wherein the coolant manifold includes a coolant supply manifold, and further comprising a coolant exhaust manifold overlapping in axial extent with the coolant supply manifold, and a plurality of coolant exhaust conduits having an axial and circumferential distribution and extending inwardly to the coolant exhaust manifold.

16. The rotor of claim 15 wherein some of the coolant supply conduits are positioned axially between coolant exhaust conduits and the coolant outlet, and some of the coolant exhaust conduits are positioned axially between coolant supply conduits and the coolant inlet.

17. The rotor of claim 15 wherein at least some of the coolant supply conduits pass through the coolant exhaust manifold.

18. A method of operating a fluid compressor comprising:

rotating a rotor within a compressor housing so as to compress a gas via impingement of an outer compression surface of the rotor on the gas, the rotor having an axial direction associated with an axis of rotation about which the rotor is rotated and a circumferential direction associated with the rotating the rotor about the axis of rotation;

conveying a coolant into a coolant manifold within the rotor, and from the manifold to coolant supply conduits within the rotor; and spraying a plurality of inner heat exchange surfaces of the rotor with the coolant from the conduits at a plurality of axially and circumferentially distributed locations, so as to dissipate heat generated by the compression of the gas; and wherein the conveying and spraying includes conveying and spraying a refrigerant in liquid form that undergoes a phase change within the rotor, and further comprising exhausting the refrigerant in gaseous form from the rotor.

19. The method of claim 18 wherein the exhausting of the refrigerant includes exhausting the refrigerant via a coolant exhaust manifold that has an axial extent overlapping with an axial extent of a coolant supply manifold supplying the plurality of coolant supply conduits.

20. The method of claim 18 which further includes flowing coolant through distinct flow paths defined by individual ones of the plurality of coolant supply conduits, plurality of inner heat exchange surfaces, and individual ones of a plurality of coolant exhaust conduits where the plurality of inner heat exchange surfaces extend between the plurality of coolant supply conduits and plurality of coolant exhaust conduits, and wherein the plurality of coolant exhaust conduits have an axial and circumferential distribution and extend inwardly to a coolant exhaust manifold.

* * * * *